US011640893B1

(12) United States Patent
Borchard et al.

(10) Patent No.: US 11,640,893 B1
(45) Date of Patent: May 2, 2023

(54) PRECISION ALIGNMENT SYSTEM FOR MILLIMETER WAVE SOURCES

(71) Applicant: Dymenso LLC, San Francisco, CA (US)

(72) Inventors: Philipp Borchard, San Francisco, CA (US); Joseph S. Hoh, Richmond, CA (US)

(73) Assignee: Dymenso LLC, San Francisco, CA (US)

( * ) Notice: Subject to any disclaimer, the term of this patent is extended or adjusted under 35 U.S.C. 154(b) by 57 days.

(21) Appl. No.: 17/530,042

(22) Filed: Nov. 18, 2021

(51) Int. Cl.
*H01J 29/04* (2006.01)
*H01J 29/54* (2006.01)
*H01J 29/66* (2006.01)

(52) U.S. Cl.
CPC ..... *H01J 29/66* (2013.01); *H01J 29/04* (2013.01); *H01J 29/54* (2013.01); *H01J 2223/083* (2013.01); *H01J 2229/481* (2013.01)

(58) Field of Classification Search
CPC ..... H01J 2223/083; H01J 2229/481; H01J 29/04; H01J 29/54
See application file for complete search history.

(56) References Cited

U.S. PATENT DOCUMENTS 6,193,430 B1 2/2001 Culpepper
8,787,529 B2 * 7/2014 Graves ..... B82Y 20/00 250/493.1
9,386,682 B2 7/2016 Tantawi
9,502,203 B1 11/2016 Borchard

FOREIGN PATENT DOCUMENTS

WO WO2018213189 11/2018

OTHER PUBLICATIONS

Martin L. Culpepper, Design and Application of Compliant Quasi-Kinematic Couplings. PhD dissertation, MIT, Feb. 2000.
Dean Putnam, Precision Alignment Techniques for Affordable Manufacture of Millimeter Wave Vacuum Devices, Navy STTR 2020. A—Topic N20A-T013, accessed Nov. 18, 2021 from www.navysbir.com/n20_A/N20A-T013.htm.
Jouni Huopana, Design of Precision Alignment of Compact Linear Colliders Accelerating Structures, Master's Thesis, University of Oulu, Aug. 31, 2007, CLIC—Note—777.
(Continued)

*Primary Examiner* — Joseph L Williams
(74) *Attorney, Agent, or Firm* — Lumen Patent Firm

(57) ABSTRACT

A high-power vacuum electron device source of 10 mm-0.1 mm wavelength radiation is composed of an electron gun joined to a RF vacuum electronic circuit. The electron gun includes a cathode, a focus electrode, and a grid. It generates an electron beam that is injected into the circuit for amplifying RF waves. The circuit is composed of metal circuit plates, e.g., copper alloy, that mate with each other and are shaped to provide a beam tunnel and RF circuit envelopes. Precision alignment pins made of nickel super alloy, are used to mutually align the metal circuit plates using elastic averaging implemented by positioning the precision alignment pins in precision alignment holes in the metal circuit plates. Preferably, the electron gun is aligned with the circuit using quasi-kinematic coupling.

14 Claims, 10 Drawing Sheets

(56) References Cited

OTHER PUBLICATIONS

Bane et al., An Advanced NCRF Linac Concept for a High Energy e+e-Linear Collider, arXiv:1807.10195 [physics.acc-ph], Sun, Apr. 7, 2019.
Philipp Borchard et al., Fabrication of Split-Section X-band Structure Using Elastic Averaging 2018, J. Phys.: Conf. Ser. 1067 082002.
Cook et al., W-Band and D-Band Traveling-Wave Tube Circuits Fabricated by 3D Printing, IEEE Access (vol. 7), Jun. 4, 2019, p. 72561-72566.
Nguyen et al., Design Methodology and Experimental Verification of Serpentine/Folded-Waveguide TWTs, IEEE Transactions on Electron Devices, vol. 61, No. 6, Jun. 2014.

* cited by examiner

PRECISION ALIGNMENT SYSTEM FOR MILLIMETER WAVE SOURCES

STATEMENT OF FEDERALLY SPONSORED RESEARCH

This invention was made with Government support under contract N683352000815 awarded by the Department of Defense. The Government has certain rights in the invention.

FIELD OF THE INVENTION

The present invention relates generally to high-power RF vacuum electron devices. More specifically, it relates to vacuum electron device sources of high-power millimeter waves.

BACKGROUND OF THE INVENTION

High power generation at millimeter wave (mm-wave) frequencies is expensive and the concurrent need for wide bandwidths at these frequencies creates an extremely challenging problem. Currently, the most stringent requirements for mm-wave power and bandwidth can only be practically met by vacuum electronics (VE) technology. At present, vacuum amplifiers with the required performance are prohibitively expensive due to the high precision machining and assembly processes involved. Specifically, the devices are constructed of metal and ceramic parts that require extremely tight tolerances that need to be maintained across proportionally large dimensions of assembled piece parts. Therefore, mm-wave device development and deployment are significantly impacted by limitations in manufacturing techniques and processes, and devices providing state-of-the-art performance are expensive due to complex manufacturing steps with relatively low yields.

Traditional methods of precision assembly such as alignment pins and in-process machining have accuracies limited to the 10-micron range or above. Furthermore, there are other issues associated with these methods. For example, in-process machining is both labor- and time-intensive, and alignment pins add additional constraints to the assembly process, introducing yet more high tolerance features in the course of achieving the desired overall precision.

SUMMARY OF THE INVENTION

In one aspect, the invention provides a high-power vacuum electron device source of 10 mm-0.1 mm wavelength radiation. In preferred embodiments, the device is designed for W-band operation and/or THz band operation.

The device includes an electron gun joined to an RF vacuum electronic circuit. Preferably, the electron gun and the circuit are joined using a quasi-kinematic coupling interface, with convex elements mating with concave recesses, resulting in arcs of contact.

The electron gun has a cathode, a focus electrode, and a grid, which are preferably all mutually aligned with kinematic couplings using ceramic silicon nitride spheres that mate to V-shaped grooves.

The RF vacuum electronic circuit has metal circuit plates that mate with each other and are shaped to provide a beam tunnel and RF circuit envelopes. The circuit plates are preferably composed of a strengthened copper alloy, more preferably pure, oxygen-free copper. The circuit also has precision alignment pins made of a nickel super alloy.

Preferably, the nickel super alloy has elastic properties at high temperature. The metal circuit plates are mutually aligned using elastic averaging implemented by positioning the precision alignment pins in precision alignment holes in the metal circuit plates. The precision alignment pins of the RF vacuum electronic circuit may have a spoke configuration, a C-shape, a triangular shape, a square shape, a rectangular shape, an elliptical shape, or a helical shape. Preferably, the precision alignment pins of the RF vacuum electronic circuit provide an alignment precision of the metal circuit plates within 10 microns, or more preferably within 1 micron.

The RF vacuum electronic circuit is preferably an RF waveguide amplifier circuit, for example, a folded, serpentine or hybrid waveguide amplifier RF circuit. The RF vacuum electronic circuit may be an RF oscillator circuit.

The RF vacuum electronic circuit may include a single circuit forming a single beam tunnel or multiple stacked circuits forming an array of electron beam tunnels.

The device may further include a waveguide connecting the RF vacuum electronic circuit to another RF vacuum electronic circuit to provide a cascading circuit configuration.

The device may further include a coupler connecting the RF vacuum electronic circuit to another RF vacuum electronic circuit to provide a parallel circuit configuration.

High precision alignment techniques provide sub-micron alignment accuracies and eliminate the labor- and time-intensive traditional assembly processes using in-process machining and manual alignment of components by skilled assembly personnel.

DETAILED DESCRIPTION OF THE INVENTION

Figure 1:
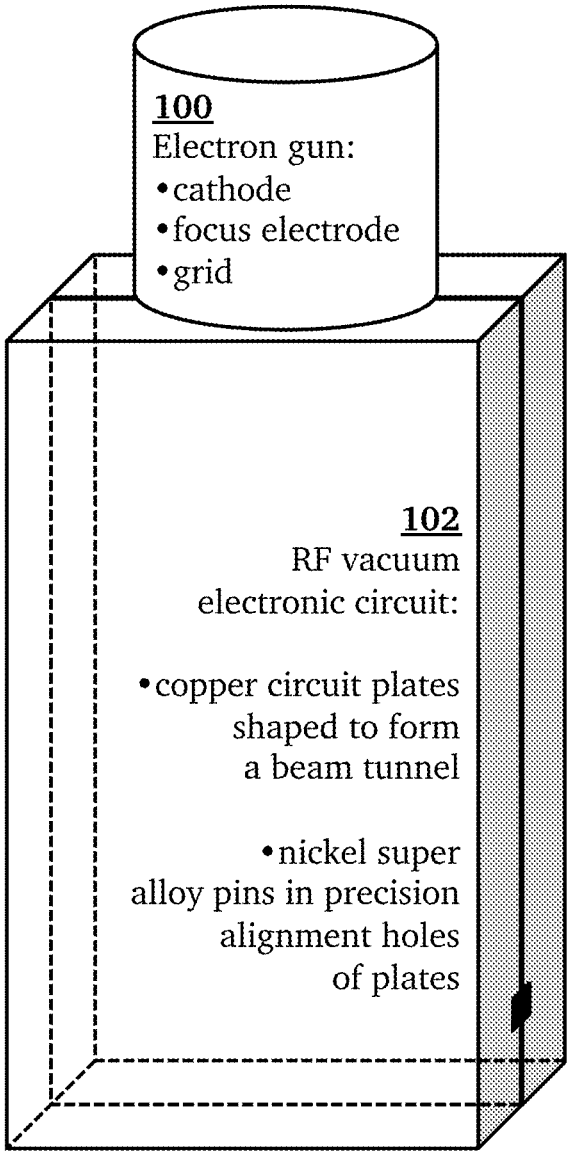
FIG. 1 is a schematic illustration of a device that is a source of mm-wave radiation, according to embodiments of the present invention.

FIG. 1 is a schematic illustration of a device that is a source of 10 mm-0.1 mm (mm-wave) radiation, according to embodiments of the present invention. The device includes an electron gun 100 joined to an RF vacuum electronic circuit 102 that is precision fabricated from two copper plates aligned utilizing elastic averaging (EA). Elastic averaging is accomplished using nickel super alloy pins. The plates are joined by brazing or electron beam welding. The RF vacuum electronic circuit may operate as an RF waveguide amplifier circuit such as a folded, serpentine or hybrid waveguide amplifier RF circuit. The RF vacuum electronic circuit may be an RF oscillator circuit. The RF vacuum electronic circuit may be used for W-band operation and/or THz band operation.

As will be described in more detail below, the circuit is made using quasi symmetric circuit half sections which are aligned using elastic averaging. The circuit halves are joined in a high temperature braze using a copper gold braze alloy. Inconel alignment pins are utilized to provide the high precision alignment from the elastic averaging interface. After the brazing process is complete, quasi-kinematic coupling targets are machined into the circuit to provide high precision alignment of an electron gun to the beam tunnel of the circuit during the process of welding the electron gun to the circuit.

Figure 2:
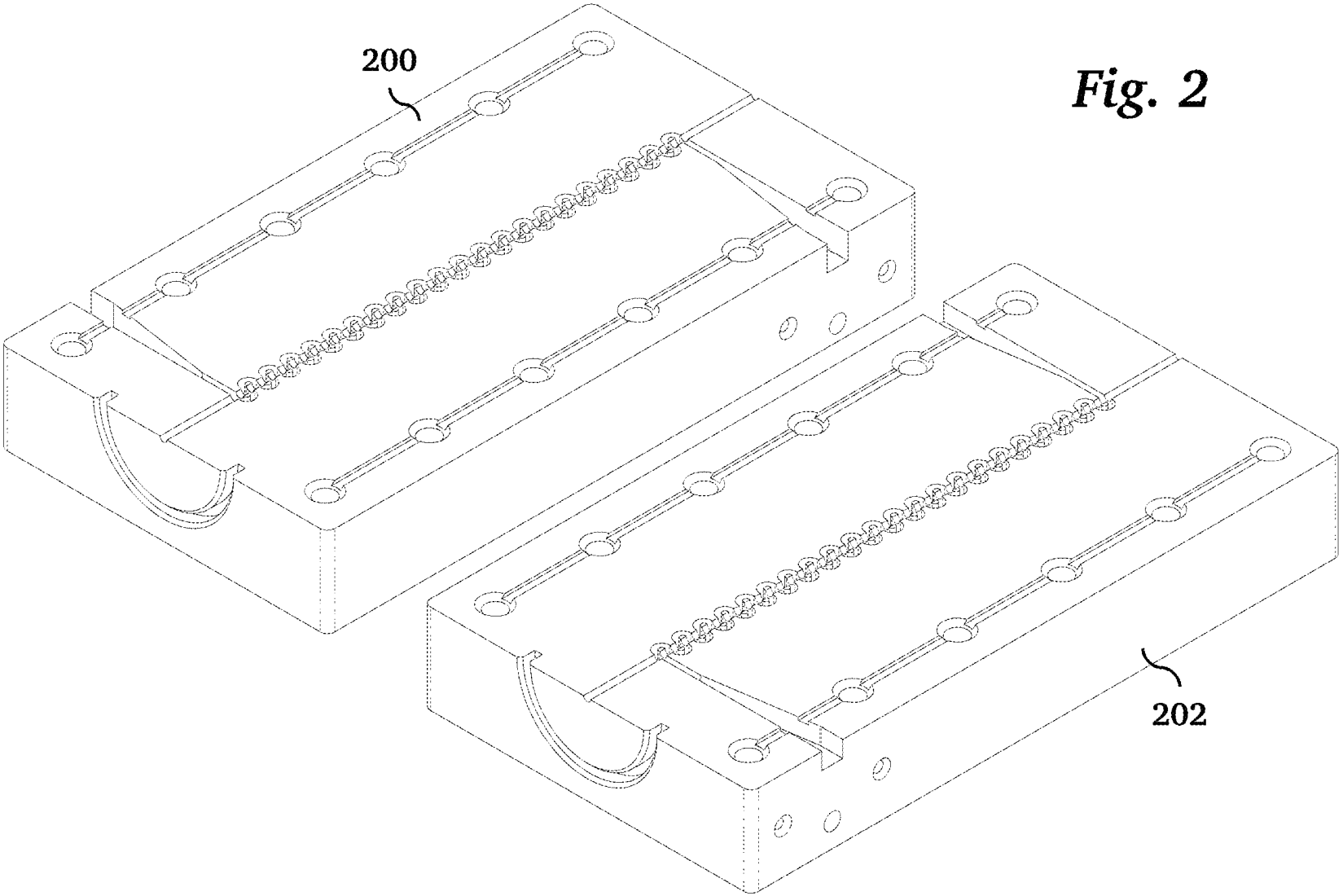
FIG. 2 is a perspective view of two halves of a RF vacuum electronic circuit, according to embodiments of the present invention.
Figure 3:
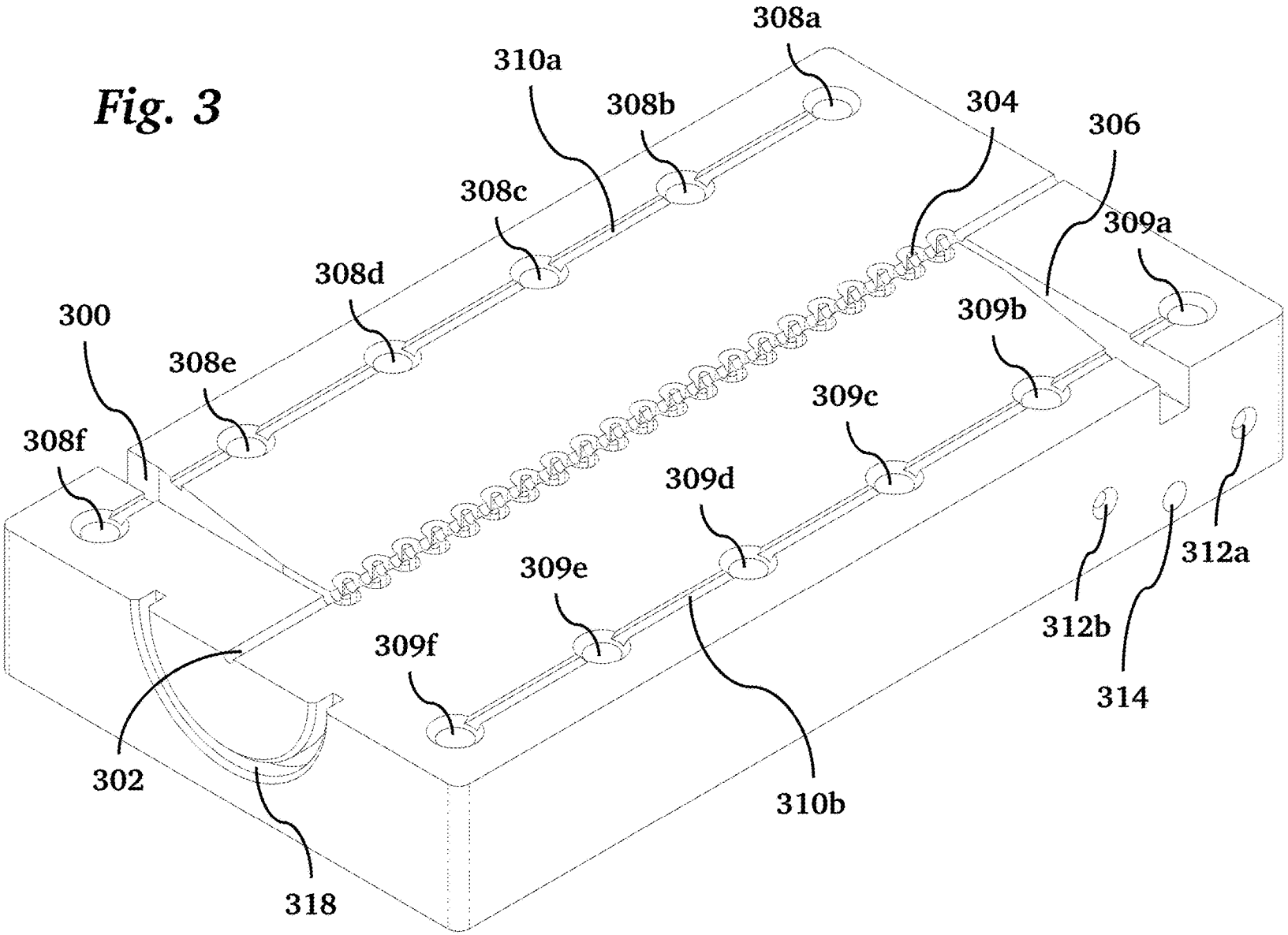
FIG. 3 shows details of the base half of the circuit shown in FIG. 2.

FIG. 2 shows the base half 200 and the top half 202 of the RF vacuum electronic circuit 102 prior to assembly. The circuit is formed out of two quasi symmetric circuit half sections which, when stacked together, will form the full circuit when they are brazed together. The circuit utilizes an elastic averaging interface coupling to provide high precision alignment between the two circuit halves. Alignment holes for the elastic averaging pins are machined into each circuit half. FIG. 3 shows the base half 200 of the circuit, with features shown in more detail. These features include an input waveguide 300 (e.g., WR-28 waveguide port) which couples RF waves from a side of the device into a beam tunnel 302 which extends the longitudinal length of the plate down its center. At the opposite end of the beam tunnel an output waveguide 306 couples RF waves from the beam tunnel to the outside of the circuit. A serpentine circuit 304 is integrated into the beam tunnel 302 between the input and output waveguides. In one embodiment, the serpentine waveguide has 21½ full periods (43 gaps). The input and output waveguides are tapered matching sections to couple power in and out of the serpentine circuit. An important feature is a step transition from the narrow part of the taper to the serpentine waveguide. This step was optimized using the code ANALYST and simulating a shorter version of the serpentine. A low-resolution simulation of the whole structure produced the reflection coefficient below −24 dB from 28 to 40 GHz. The step transition to the serpentine waveguide at the narrow part of the taper was smoothed out by adding a fillet. The position and radius of the fillet were varied to minimize reflection. Other dimensions were also varied to assess sensitivity.

The plate also has two groups of pin alignment holes 308*a*, 308*b*, 308*c*, 308*d*, 308*e*, 308*f* and 309*a*, 309*b*, 309*c*, 309*d*, 309*e*, 309*f* arranged near opposite sides of the plate. The pins in each group are arranged linearly in the longitudinal direction parallel to the beam tunnel 302 and are connected to each other by venting slots 310*a*, 310*b*. The two venting slots 310*a*, 310*b* are also parallel to the beam tunnel. Slot 310*a* couples to the input waveguide 300 while slot 310*b* couples to the output waveguide 306.

The plate also includes on its sides near the output waveguide exit waveguide alignment holes 312*a*, 312*b* and a threaded hole 314. The plate also includes similar features positioned on its sides near the input waveguide exit. These features facilitate coupling of the circuit to other devices used in standard WR-28 waveguide connections.

The principle of elastic averaging states that the accuracy of an interface can be improved by averaging errors using controlled compliance between precision surfaces. The key to elastic averaging is to have a large number of features spread over a broad region that elastically deform when separate parts are forced into geometric compliance with each other. As the system is preloaded, the elastic properties of the material allow for the size and position error of each individual contact feature to be averaged out over the sum of the contact features throughout the solid body.

Figure 4:
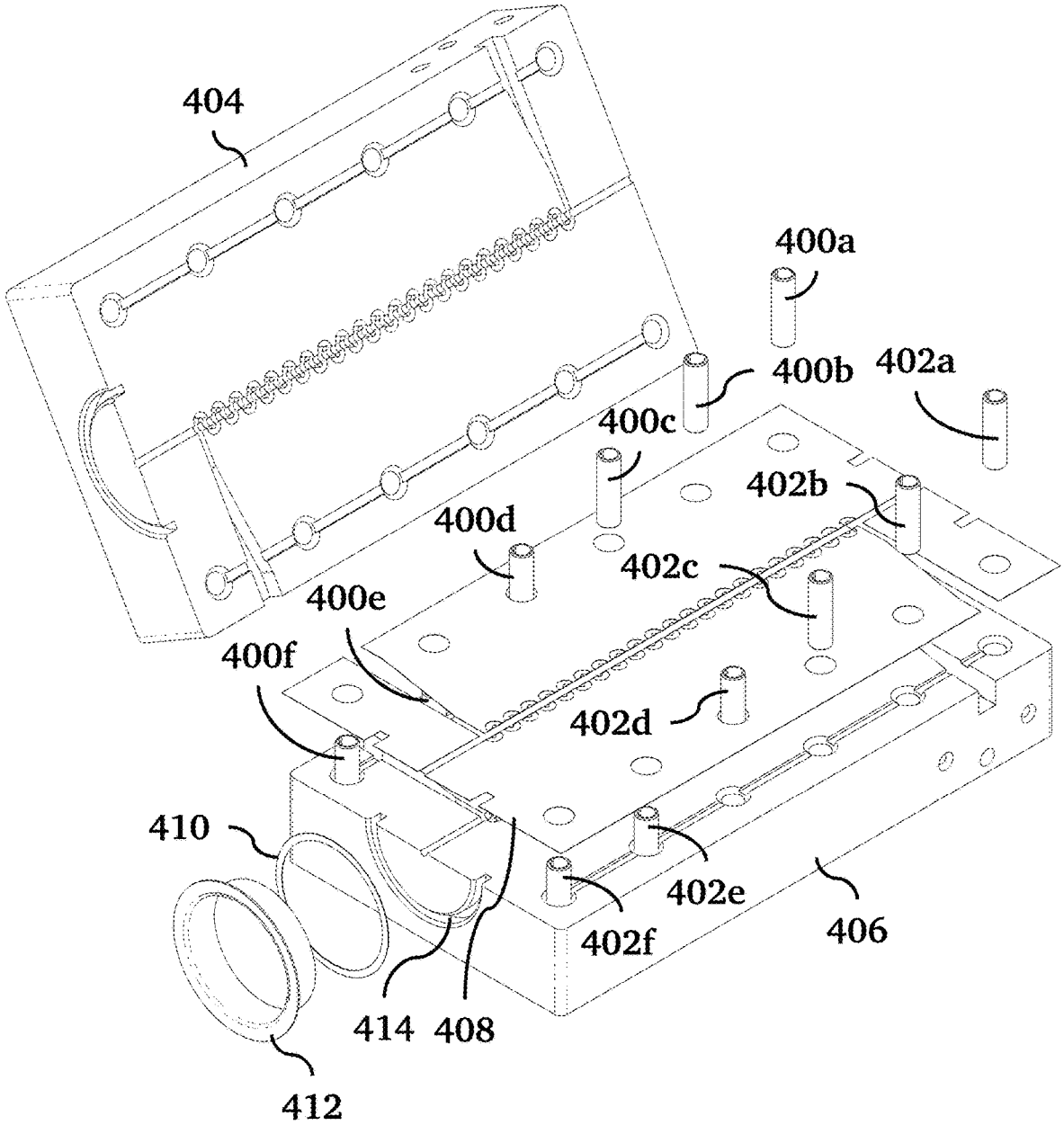
FIG. 4 illustrates the two halves of the circuit shown in FIG. 2 together with braze alloy, seal ring, and precision alignment pins used to implement elastic averaging in the circuit, according to embodiments of the present invention.

As shown in FIG. 4, elastic averaging in the circuit is implemented though the use of 12 C-shaped Inconel alignment pins 400*a*, 400*b*, 400*c*, 400*d*, 400*e*, 400*f* and 402*a*, 402*b*, 402*c*, 402*d*, 402*e*, 402*f*. The precision alignment pins are made of a nickel super alloy. The Inconel alloy is chosen because of the fact that it maintains elastic material properties at the elevated temperatures of a brazing furnace. In order for the elastic averaging to work, it is important that the pins material remain elastic at the temperature used to braze the circuit top 404 and base 406 together. The pins are designed to be oversized relative to the alignment hole to ensure that there will be contact between each pin and hole.

The copper gold alloy braze sheet 408 is pattered to cover areas of the two plates where they match, i.e. the sheet has cut outs that match the features of the circuit where the two plate surfaces do not contact. A braze alloy 410 is also used to braze a seal ring 412 to the circuit around the beam tunnel entrance. The braze sheet used for joining the two sections is a custom cut preform which locates the braze alloy away from RF circuit features to avoid any braze material fill-in during the braze process. The braze material also features cutouts for the alignment pins and the waveguide taper section.

The copper circuit plates 404 and 406 mate with each other and are shaped to provide input and output waveguides, a beam tunnel, and RF circuit envelopes, as described above in relation to FIG. 3. The copper circuit plates are mutually aligned using elastic averaging implemented by positioning the precision alignment pins 400 and 402 in the precision alignment holes 308 in the copper circuit plates. In a preferred embodiment, each pin is designed with a C-shape (having a slot cut along the axial length of the hollow cylindrical pin) to provide the flexibility for each pin to elastically deform within each alignment hole. For C-shaped alignment pins, the pin wall thickness is preferably 6-16% of the pin diameter. For example, a C-shaped pin with a 0.250 inch diameter and a 10% wall thickness ratio would have a wall thickness of 0.025 inch, resulting in a 0.250 inch outer diameter and a 0.200 inch inner diameter. This ratio is important because if the wall is too thin, then the spring force is insufficient to achieve the elastic averaging, whereas if the wall is too thick, then the pins are too stiff to assemble the structure without damage. Alternatively, the precision alignment pins of the RF vacuum electronic circuit may have a spoke configuration, a triangular shape, a square shape, a rectangular shape, an elliptical shape, or a helical shape. Preferably, the precision alignment pins of the RF vacuum electronic circuit provide an alignment precision of the copper circuit plates within 10 microns, or more preferably within 1 micron. Alternatively, the circuit plates can be fabricated from strengthened copper alloys such as precipitation hardened Copper-Chromium-Zirconium or dispersion strengthened copper alloys. Dispersion strengthened copper alloys such as GLIDCOP with aluminum oxide ceramic particles or Copper-Chrome-Niobium dispersion strengthened copper-alloy. These strengthened copper alloys exhibit good thermal and electrical conductivity, typically 80-90% of oxygen free copper, along with high temperature strength and extended fatigue life in high temperature, high heat flux applications such as RF circuits.

Brazing the circuit involves the two circuit halves (base 406 and top 404), 12 elastic averaging alignment pins (400*a*, 400*b*, 400*c*, 400*d*, 400*e*, 400*f* and 402*a*, 402*b*, 402*c*, 402*d*, 402*e*, 402*f*), and seal ring 412 to accommodate the welding of an electron gun to the circuit, and a set of custom cut copper gold braze alloy washers 408 and 410. In the brazing assembly process, the alignment pins are first inserted into the base circuit section 406. The braze alloys sheet 408 is then placed on top of the circuit base 406 after which the top half circuit section 404 is placed on top. The braze washer 410 and seal ring 412 are then placed into the appropriate groove 414 at which point the assembly is ready for the braze furnace.

After the circuit is brazed, an electron gun is joined to the circuit. Preferably, the electron gun and the circuit are joined using a quasi-kinematic coupling interface, with convex elements mating with concave recesses, resulting in arcs of contact.

Kinematic couplings feature a ball-in-groove joint where three balls on one component mate with three grooves on the second component with small area contacts. Kinematic couplings have long been known to provide an economical and dependable method for attaining high repeatability in fixtures.

A Quasi-Kinematic Coupling (QKC) is a type of coupling which operates on both elastic and kinematic design principles. In their generic form, they have three contactors, which are ball shaped convex solids attached to one component which mate with three corresponding targets, which are a circular concave element in the second component. Reliefs are cut into each target which create six contact arcs on the second component, emulating the six contact points of a kinematic coupling. The reliefs are cut so that the mid-plane of the reliefs are oriented parallel to the angle bisector of the coupling triangle. Another consideration to be taken into account is that the material of the contactor should be chosen so that the hardness is at least four times that of the material of the target.

Figure 5:
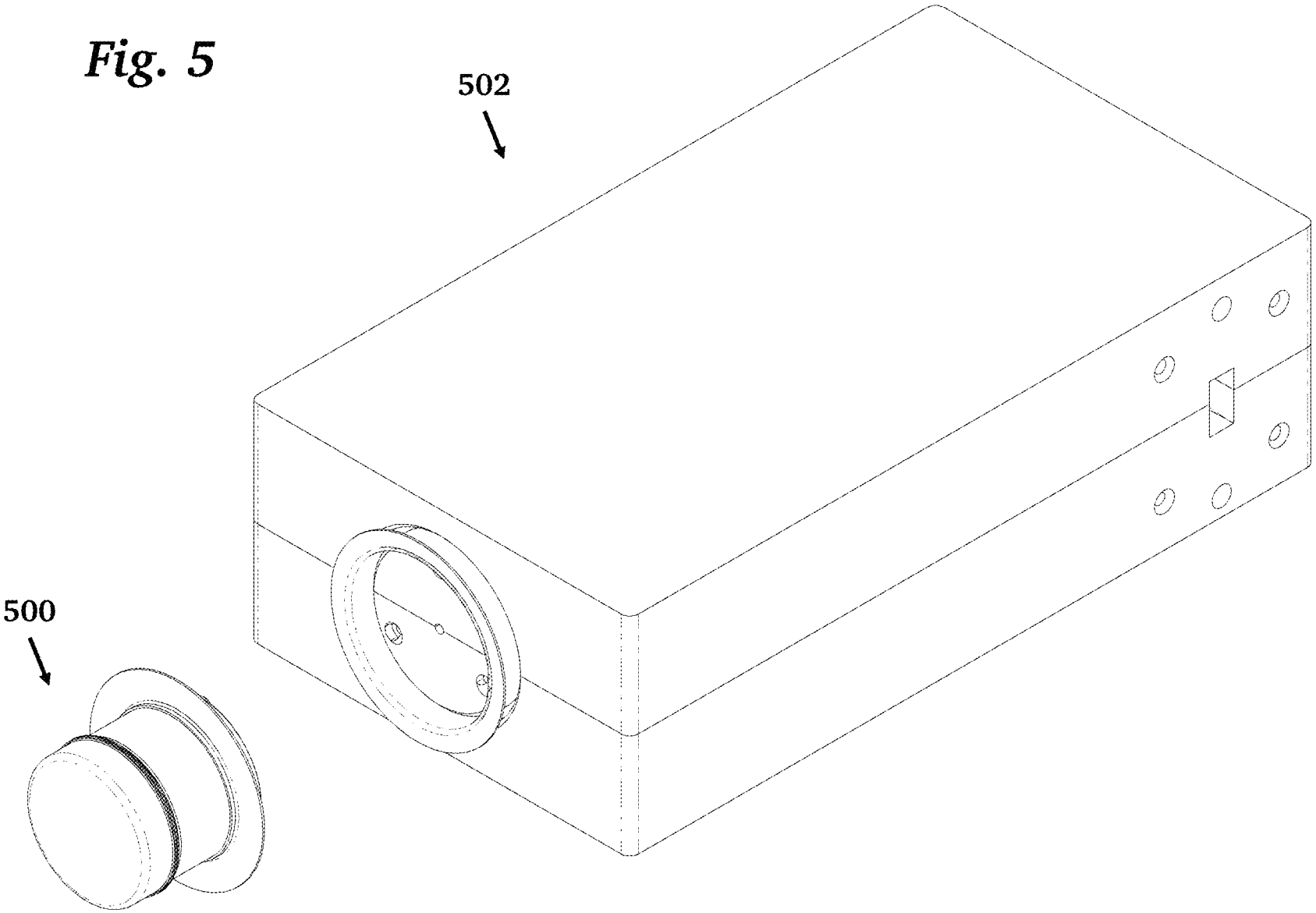
FIG. 5 is a perspective view illustrating the joining of an electron gun to an assembled RF vacuum electronic circuit, according to embodiments of the present invention.
Figure 6:
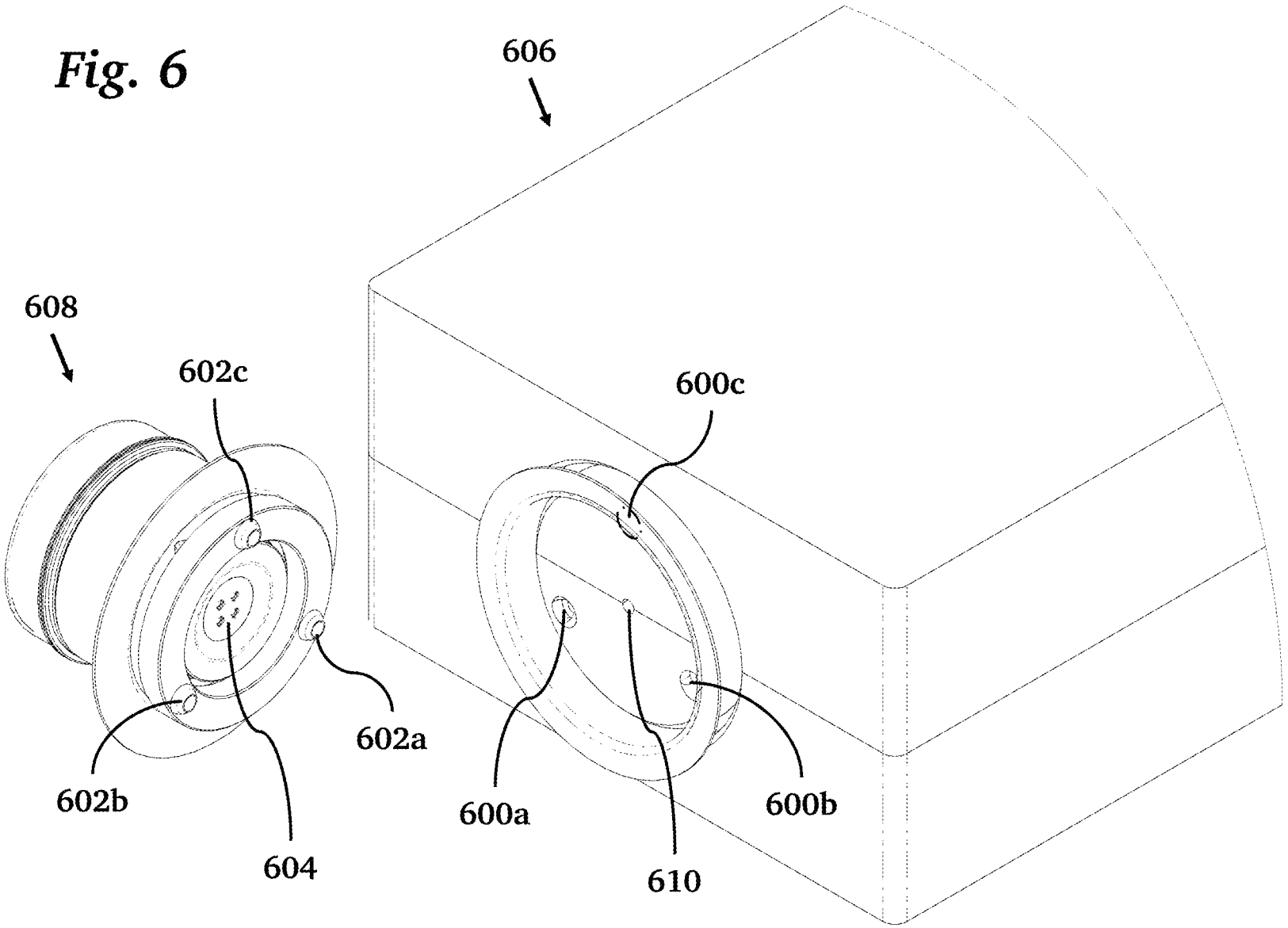
FIG. 6 illustrates details of the components used for joining the electron gun and circuit shown in FIG. 5.

In preferred embodiments of the present invention, an election gun 500 is aligned with and joined to the end of the circuit 502, as shown in FIG. 5. The electron gun 608 has a cathode, a focus electrode, and a grid 604, as shown in FIG. 6. Internal to the gun 608, the cathode, focus electrode, and grid of the electron gun are all mutually aligned with kinematic couplings using ceramic silicon nitride or nickel-based superalloy with spherical or revolved contact surfaces that mate to V-shaped grooves. The electron gun is used to generate an electron beam that is injected into the RF circuit beam line where the electron stream moves in the field of a traveling electromagnetic wave whose phase velocity is slowed to the beam velocity by e.g. helices, coupled cavities, or ring bar and ring loop. When the velocities are approximately equal, the RF wave amplifies.

Figure 7:
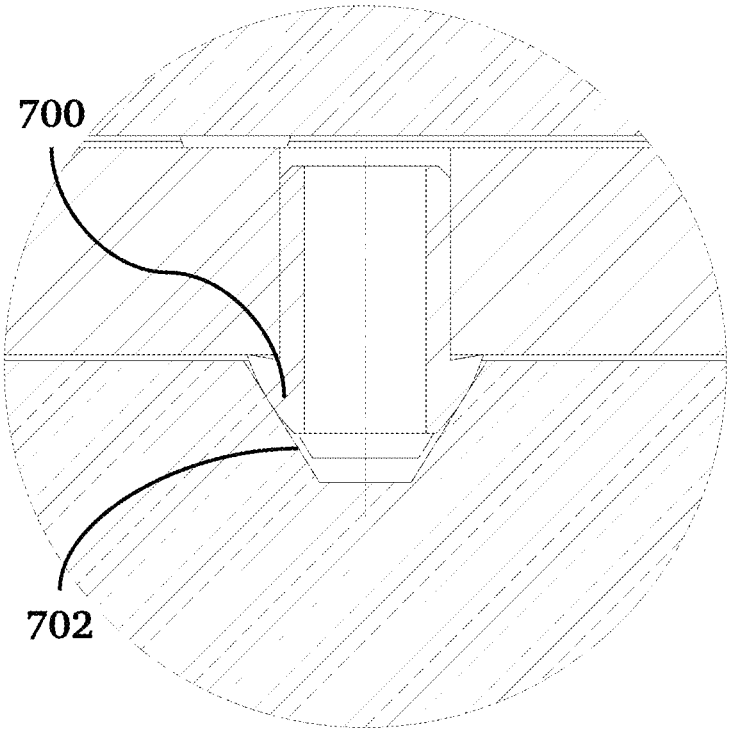
FIG. 7 shows detail of a convex shaped quasi-kinematic coupling contactor of the electron gun mated with a corresponding concave quasi-kinematic coupling target machined into the circuit of FIG. 6.

The gun 608 and circuit 606 are precision aligned using quasi-kinematic coupling, where three stainless steel spherical protrusions contactors 602*a*, 602*b*, 602*c* mate to three corresponding conical grooves targets 600*a*, 600*b*, 600*c*. In order to ensure that the locations of the three QKC targets 602*a*, 602*b*, 602*c* are precisely positioned to provide alignment of the center of the grid 604 of the electron gun 608 with the beamline entrance 610 of the circuit 606, they are machined into the circuit after the circuit is brazed. The targets are designed so that they are inside the envelope of the seal ring and so that the reliefs of the targets are aligned with the angle bisectors of the coupling triangle formed by the targets. Once the three QKC targets 600*a*, 600*b*, 600*c* are machined into the circuit, the election gun is attached to the circuit by placing its three mating QKC contactors 602*a*, 602*b*, 602*c* into the targets that have been machined into the brazed circuit assembly to provide a high precision alignment and by creating a weld using the seal ring that was brazed to the circuit. FIG. 7 shows detail of a convex shaped QKC contactor 700 of the gun mated with a corresponding concave QKC target 702 machined into the circuit. The goal of the QKC is to minimize the effects of surface geometry on coupling performance. When the contactor and target are pressed together, normally with no sliding, the surfaces of each material will deform and conform to each other. However, for two QKC components A and B, if component A is approximately four times harder than component B, then the surface of A will not be affected by the geometry of surface B. It is simpler and less expensive to obtain a better surface finish on the contactor. Therefore, the ratio of contactor hardness to target hardness is preferably approximately four. Since the Brinell hardness of metals is proportional to the tensile strength, this allows one to use the ratio of contactor to target tensile strength in place of the hardness ratio. In the mm-wave device application, the ratio of four to one for the material tensile strength is satisfied for the two materials most commonly used in vacuum electronic devices, namely annealed copper and annealed stainless steel.

To achieve mating of opposed faces, the compliance of the quasi kinematic elements was chosen such that a preload will close the initial gap. The gap will be closed by elastic deformation of the contactor surface and elastic and plastic deformation of the target surface. On removal of the load, part of the gap is restored through elastic recovery of the kinematic elements, thereby preserving the kinematic nature of the joint for subsequent mates. In the first load step an axial preload is applied resulting in an axial compression of 60 microns and eliminating the assembly gap between the two components. The preload is then removed and a portion of the gap is restored due to elastic recovery. The elastic recovery preserves the kinematic nature of the joint for subsequent mates.

One key advantageous feature is providing 1 micron alignment over 5 cm while maintaining ultra-high vacuum compatibility and capability with device processing at 500° C. without loss of alignment. (This advantage also applies to the elastic averaging of the circuit) An ANSYS Mechanical finite element analysis (FEA) was performed on the QKC mating system, the analysis included non-linear material properties and contact between components. ANSYS Mechanical FEA simulation was performed on the QKC for design optimization and verification of the preservation of alignment over a 500° C. bake-out cycle. A preload was applied to seat the gun against the circuit block, closing a five micron assembly gap and bringing the adapter ring into contact with the circuit block. For the second load step, the temperature was linearly ramped to 500° C. which caused the electron gun to anode spacing to increase by 17 microns as shown by the red curve. For the third load step, the temperature is ramped back down to room temperature, the original axial spacing are fully restored, after the completion of the bake-out cycle the axial spacing was altered by less than 0.1 microns, while the transverse alignment was preserved throughout the entire bake-out cycle.

Figure 8A:
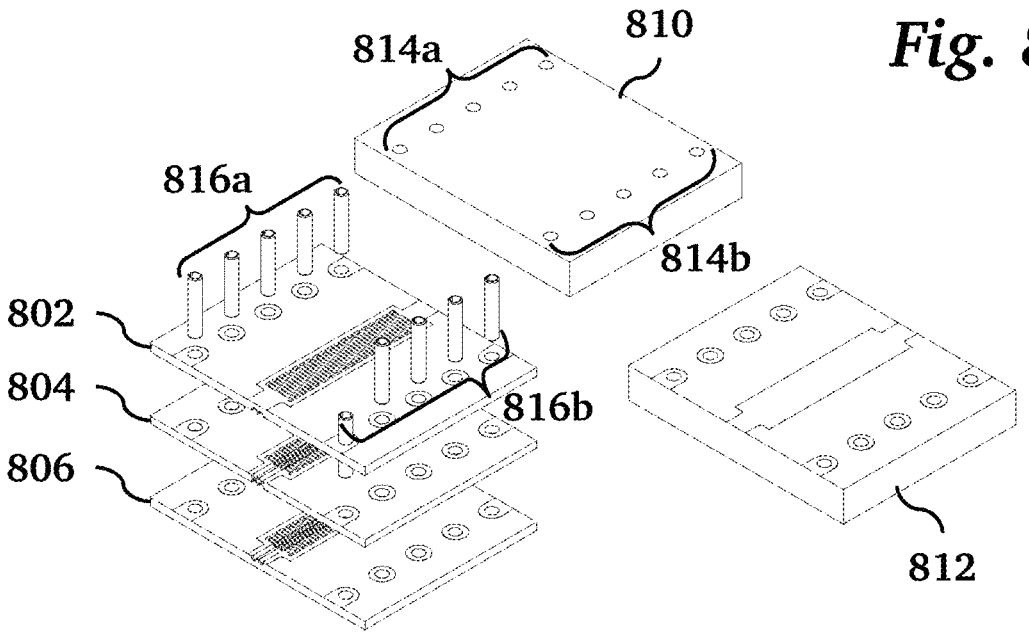
FIG. 8A is a perspective view of multiple plates that can be stacked to form an array of RF circuits and parallel electron beam tunnels, according to embodiments of the present invention.
Figure 8B:
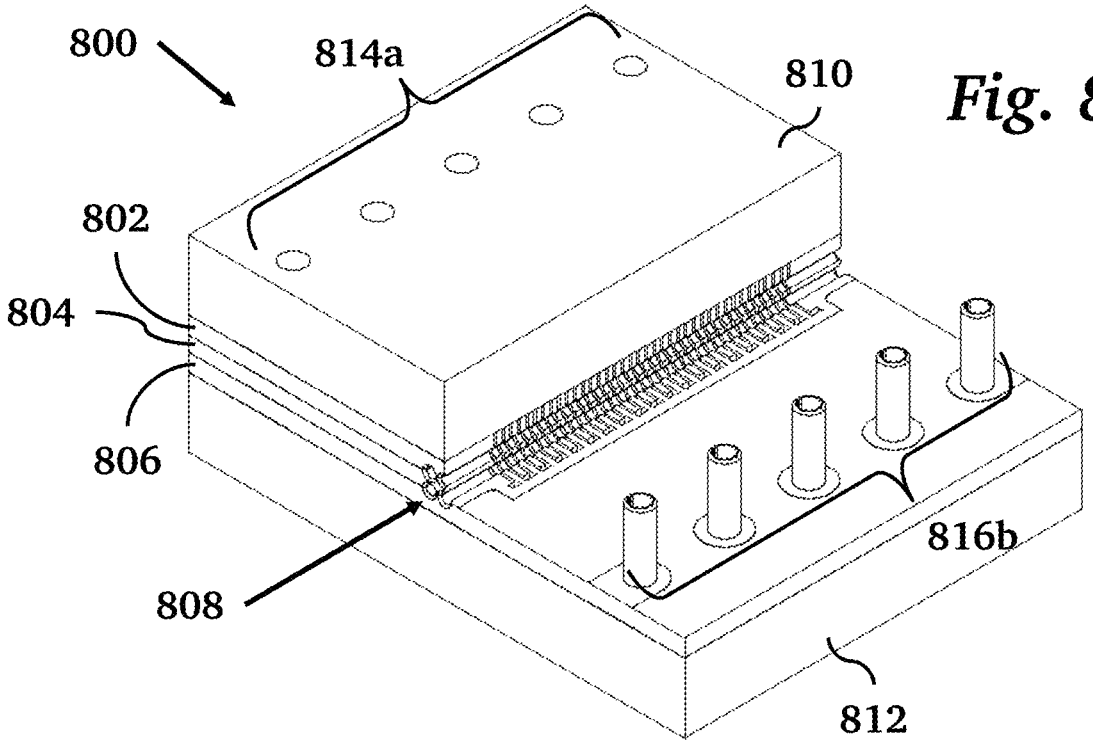
FIG. 8B is a perspective cut-away view of a multiple-stacked RF circuit assembled from the plates shown in FIG. 8A.

As described and illustrated above, the RF vacuum electronic circuit may include a single circuit forming a single beam tunnel. In alternate embodiments, the circuit 800 may include multiple stacked circuit plates 802, 804, 806 between base and top half plates 810, 812 forming an array 808 of electron beam tunnels, as illustrated in FIG. 8A and FIG. 8B. All the plates include pin alignment holes arranged in two rows, e.g., 814*a*, 814*b*, into which are fitted two corresponding sets of precision alignment pins 816*a*, 816*b*. The circuit is otherwise the same as the single-beam-tunnel circuit described above.

Figure 9A:
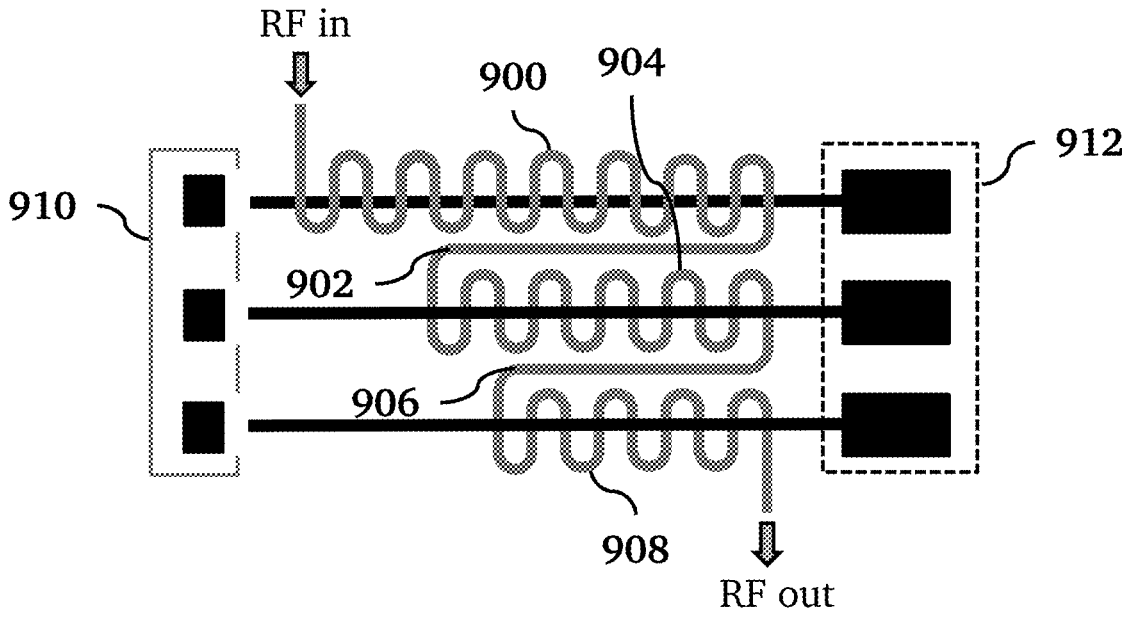
FIG. 9A is a schematic illustration of a mm-wave source device formed by connecting multiple RF circuits in a cascading configuration, according to embodiments of the invention.

As shown schematically in FIG. 9A, the device may further include a waveguide 902 connecting the output of a RF vacuum electronic circuit 900 to the input of another RF vacuum electronic circuit 904. Another waveguide 906 may connect the output of the second RF vacuum electronic circuit 904 to the input of another RF vacuum electronic circuit 908. The three circuits have three corresponding beam tunnels fed by three multi-beam electron guns 910 and terminating in a multi-beam collector 912. Generally, two or more circuits may be connected by waveguides in this way to provide a cascading circuit configuration having multiple beam tunnels fed by multiple guns terminating in multiple collectors.

Figure 9B:
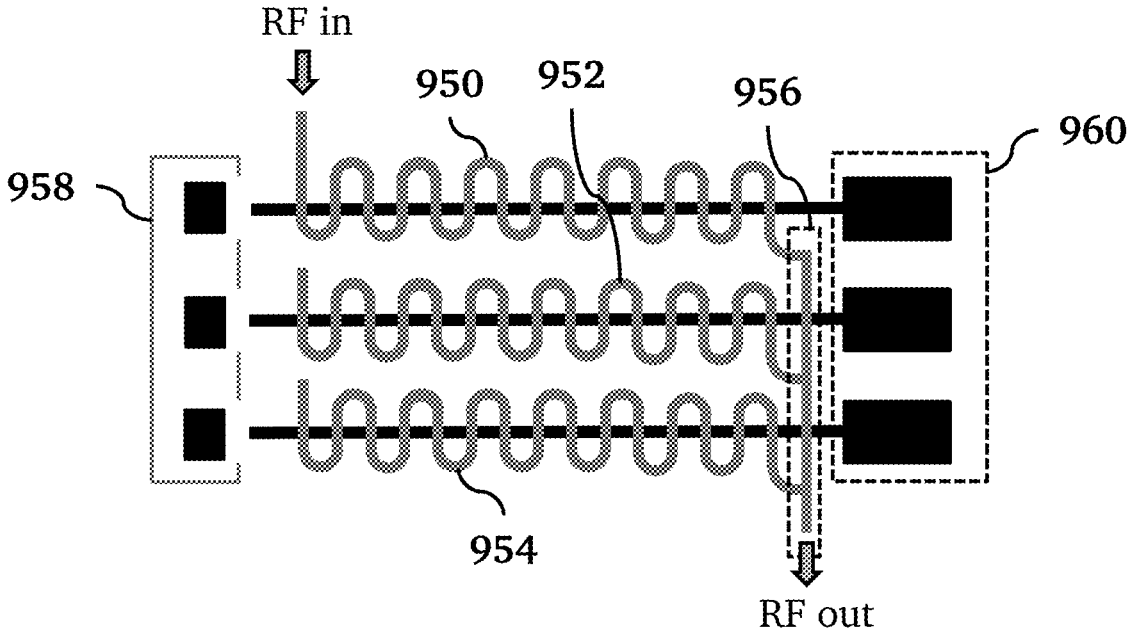
FIG. 9B is a schematic illustration of a mm-wave source device formed by connecting multiple RF circuits in a parallel circuit configuration, according to embodiments of the invention.

Multiple circuits may also be connected in a parallel circuit configuration, as shown schematically in FIG. 9B. The device in this example may further include a coupler 956 connecting outputs of three RF vacuum electronic circuits 950, 952, 954. The circuit inputs are fed separately or have a common feed using an input coupler. The three circuits have three corresponding beam tunnels fed by three multi-beam electron guns 958 and terminating in a multi-beam collector 960. Generally, two or more circuits may be connected an output coupler in this way to provide a parallel circuit configuration having multiple beam tunnels fed by multiple guns terminating in multiple collectors.

A high-power vacuum electron device source of 10 mm-0.1 mm wavelength radiation according to embodiments of the invention allow for serpentine waveguide traveling wave tube (TWT) high-power (>100 W) millimeter amplifier circuits operating in the W-band (75-110 GHz) and above frequency range with wide instantaneous bandwidth as required for high-resolution radar and high-data-rate communications. Another application of TWTs is in imaging. The wide band and high power at millimeter waves permit high resolution and stand-off imaging. The TWT amplifier may be used as a component in a communication system.

The invention claimed is:

1. A high-power vacuum electron device source of 10 mm-0.1 mm wavelength radiation comprising:

a) an electron gun having
  i) a cathode,
  ii) a focus electrode, and
  iii) a grid;

b) a RF vacuum electronic circuit comprising:
  i) metal circuit plates that mate with each other and are shaped to provide a beam tunnel and RF circuit envelopes,
  ii) precision alignment pins made of nickel super alloy, wherein the metal circuit plates are mutually aligned using elastic averaging implemented by positioning the precision alignment pins in precision alignment holes in the metal circuit plates.

2. The device of claim 1 wherein the device is designed for W-band operation and/or THz band operation.

3. The device of claim 1 wherein the i) cathode, ii) focus electrode, and iii) grid of the electron gun are all mutually aligned with kinematic couplings using ceramic silicon nitride spheres that mate to V-shaped grooves.

4. The device of claim 1 wherein the i) cathode, ii) focus electrode, and iii) grid of the electron gun are all mutually aligned with kinematic couplings using ceramic silicon nitride with spherical or revolved contact surfaces that mate to V-shaped grooves.

5. The device of claim 1 wherein the i) cathode, ii) focus electrode, and iii) grid of the electron gun are all mutually aligned with kinematic couplings using nickel-based superalloy with spherical or revolved contact surfaces that mate to V-shaped grooves.

6. The device of claim 1 wherein electron gun and circuit are joined using a quasi-kinematic coupling interface, with convex elements mating with concave recesses, resulting in arcs of contact.

7. The device of claim 1 wherein the precision alignment pins of the RF vacuum electronic circuit have a spoke configuration, a C-shape, a triangular shape, a square shape, a rectangular shape, an elliptical shape, or a helical shape.

8. The device of claim 1 wherein the precision alignment pins of the RF vacuum electronic circuit provide an alignment precision of the metal circuit plates within 10 microns.

9. The device of claim 1 wherein the RF vacuum electronic circuit is an RF waveguide amplifier circuit.

10. The device of claim 1 wherein the RF vacuum electronic circuit is a folded, serpentine or hybrid waveguide amplifier RF circuit.

11. The device of claim 1 wherein the RF vacuum electronic circuit is an RF oscillator circuit.

12. The device of claim 1 wherein the RF vacuum electronic circuit comprises stacked circuits forming an array of electron beam tunnels.

13. The device of claim 1 further comprising a waveguide connecting the RF vacuum electronic circuit to another RF vacuum electronic circuit to provide a cascading circuit configuration.

14. The device of claim 1 further comprising a coupler connecting the RF vacuum electronic circuit to another RF vacuum electronic circuit to provide a parallel circuit configuration.

* * * * *